United States Patent [19]

Williams

[11] 4,090,710

[45] * May 23, 1978

[54] TRAINING TENNIS RACKET

[76] Inventor: Roy G. Williams, 4905 Hermitage Dr., Raleigh, N.C. 27612

[ * ] Notice: The portion of the term of this patent subsequent to Jan. 4, 1991, has been disclaimed.

[21] Appl. No.: 653,157

[22] Filed: Jan. 28, 1976

[51] Int. Cl.[2] ..... A63B 49/08

[52] U.S. Cl. ..... 273/75

[58] Field of Search ..... 273/26 R, 73 R, 73 J, 273/75, 81 R, 81.4, 165, 163 A, 194 R, 183 D; 35/29 R, 29 A; D34/5 ST

[56] References Cited

U.S. PATENT DOCUMENTS

| | | | |
|---|---|---|---|
| D. 242,937 | 1/1977 | Williams | D34/5 ST |
| 1,603,850 | 10/1926 | Keating | 273/163 A |
| 1,917,236 | 7/1933 | Bloomstrand | 273/75 X |
| 2,925,273 | 2/1960 | Pratt | 273/26 R |
| 3,110,494 | 11/1963 | Morgan | 273/26 R |

FOREIGN PATENT DOCUMENTS

| | | | |
|---|---|---|---|
| 762,059 | 1/1934 | France | 273/75 |

OTHER PUBLICATIONS

"Golf Digest," Jul. 1971; p. 82.

*Primary Examiner*—Richard J. Apley

[57] ABSTRACT

A training and playing tennis racket having indicia immediately above the handle for orienting the player's hand grasp for various strokes including the forehand, backhand, service, overhead and volley grips to aid the tennis player to position the appropriate grip readily during training and playing without cumbersome structure.

5 Claims, 6 Drawing Figures

TRAINING TENNIS RACKET

BACKGROUND, ADVANTAGES AND OBJECTIVES OF THE INVENTION

The game of tennis has reached unprecedented popularity in recent years, and many books have been written on the subject optimum ways to grip a tennis racket. Many devices have also been promoted to assist the novice tennis player to grip the tennis racket in a prescribed manner. Certain techniques have been developed for executing various strokes using preferred grips.

Usually the novice and experienced tennis players determine that it is advantageous to employ a particular grip or style best suited to the individual's game for a forehand grip, a backhand grip, a service and overhead grip as well as volley grip with each varying to a certain extent from the other. Consistency of each grip for a particular stroke is highly desirable, and the player will find it advantageous to rotate the handle rapidly depending upon the specific requirement without looking at the racket handle during play. The sooner one becomes accustomed to the proper grip for a particular shot, the greater ease one will have in handling the racket during play.

Although there is a wide variety of grips recommended, there are certain basic grips that have been found to be highly desirable for superior playing. Usually tennis professionals and teachers seek to have beginners practice standard grips over extended periods of time but the beginner as well as the experienced player usually returns to fundamentals of the grip for practice and perfection. Resort may not always be available for guidance from an experienced player or professional. A player finds it difficult frequently to refer to illustrations in a book or photograph or a set of instructions as opposed to incorporating an aid directly above the tennis racket handle.

It is therefore an objective of this invention to provide a tennis racket with one or more positions for a grip for various strokes during play to aid the player whether novice or experienced.

Another objective of this invention is the provision of a tennis racket shaft that incorporates indicia thereon which will serve as an aid to the player to grip the tennis racket in a suitable manner for a particular stroke.

Yet another objective of this invention is the provision of a tennis racket shaft in which one or more indicia may be employed as a teaching aid to assist in training a tennis player to hold a tennis racket for specific grips.

Other objects of this invention are to provide certain indicia which serve as ready and continuous feeling positions for the tennis player in handling a tennis racket to orient it to the proper stroking position for practice and playing.

Yet other objectives of this invention will be readily apparent to those familiar with the game of tennis when considered with the accompanying drawing and detailed description which follow of which there are many modifications and variations contemplated within the scope of the appended claims.

DESCRIPTION OF THE DRAWING OF A PREFERRED EMBODIMENT

DETAILED DESCRIPTION OF A PREFERRED EMBODIMENT OF THE INVENTION

Figure 1:
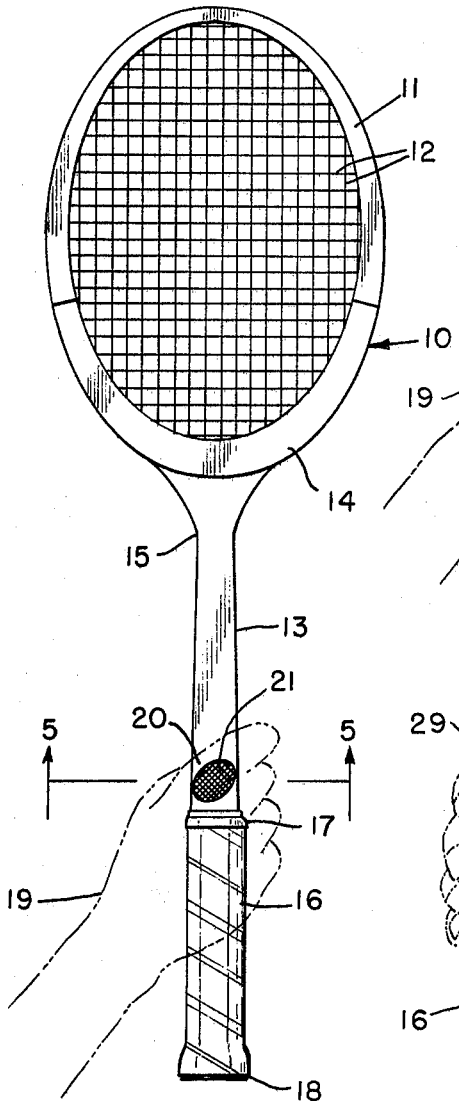
FIG. 1 is a front elevational view of a tennis racket incorporating indicium above the handle grip for a forehand grip with the grasping hand shown in outline form.

Referring to the drawing and particularly to FIG. 1, there is illustrated a conventional tennis racket 10 in which a frame 11 is shown in elliptical form and strung in the usual manner with horizontal and vertical strings 12 of gut or wire. The handle 13 extends from the base 14 of the frame connecting through the neck 15. At the lower portion 16 of the handle 13 is a wrapping of leather or other suitable material in helical form with a securing band 17 and a base plug or tape 18 at the terminal end.

It will be readily appreciated that although this invention is described in conjunction with a tennis racket, rackets for badminton, paddle tennis as well as rackets for other sports may be provided with comparable indicia means for training purposes. Furthermore, for the purpose of this specification, the term "handle" will consist of that portion of the tennis racket from the extremity to a position directly beneath the neck 15.

As illustrated in FIG. 1, a player's right hand 19 is shown grasping the handle 13 of the tennis racket with the underside of the index knuckle 20 of the hand 19 positioned to grip and reside directly over the oval-shaped indicium 21 that is securely fastened to the rear face of the tennis racket opposite from the service face and constitutes the forehand grip. The indicium 21 may be in the form of a decal adhered to the outer surface of the handle or may be positioned in an indentation which may be provided on the handle face 22 as shown in the recess 23 which may accommodate at least partially the index knuckle of the player with the indentation having the proper contour. However, should the player desire to merely use the indicium 21 as a locating position, the grip may be placed lower on the handle around the wrapping 16 during play at which time the indicium 21 serves as a locator for the forehand grip.

The righthanded player may orient the forehand grip initially by placing the underside of the index knuckle on the indicium 21 which may be in the form of a tennis racket head and then slide the hand downwardly to the wrapped section 16 while retaining the index knuckle in the same location permitting the player's fingers to assume the most comfortable grasping grip for forehand strokes.

Figure 2:
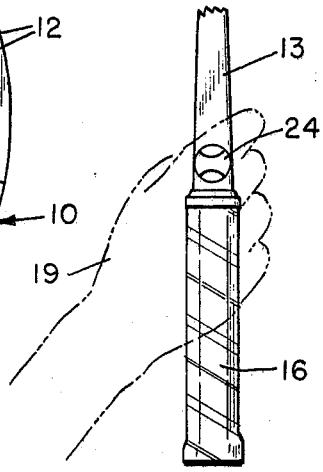
FIG. 2 is a right side partial elevational view of a tennis racket handle of FIG. 1 incorporating another indicium above the handle grip for a backhand grip with the grasping hand shown in outline form.
Figure 3:
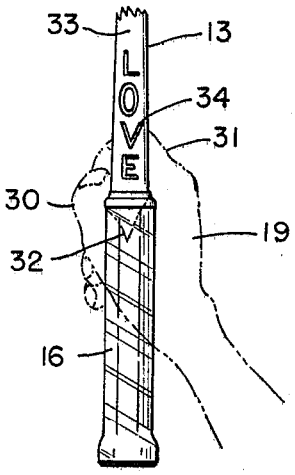
FIG. 3 is a left side partial view of the handle of the tennis racket of FIG. 1 incorporating another indicium above the handle grip for a volley grip with the grasping hand shown in outline form.

There is illustrated in FIG. 2 the handle portion of FIG. 1 at the right side thereof in which the indicium 24 is in the form of a tennis ball for a backhand grip for the righthanded player in which the underside of the index finger at the knuckle is placed on the tennis ball 24 in order to locate the proper backhand grip position. Once the hand 19 assumes the proper backhand grip by locating the underside of the index finger on the tennis ball indicium 24, the hand may be lowered to the wrapped portion 16 for play.

Figure 5:
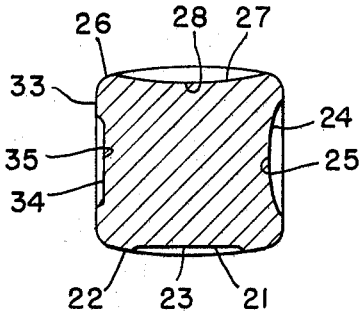
FIG. 5 is a transverse sectional view taken along the section line 5—5 of FIG. 1 in which the indentations may be employed to receive the indicia of the various types employed.

The tennis ball indicium 24 may also be in the form of a decal which may be embedded into the recess 25 as shown in FIG. 5 of the racket handle or it may be secured as a decal without any indentation, if desirable and properly protected against wear.

Figure 4:
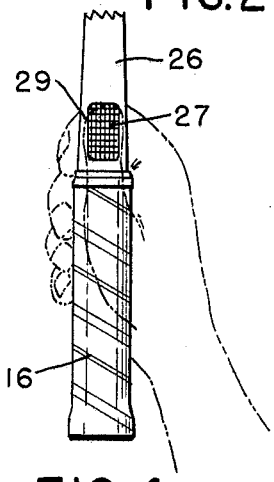
FIG. 4 is a rear partial elevational view of the tennis racket handle of FIG. 1 incorporating another indicium above the handle grip for an auxiliary backhand grasp with the thumb outline over the indicium of the grasping hand also shown in outline form.

In the backhand grip shown in FIG. 2, the player may utilize this grip without any modification or the player may desire to have further aid in locating the backhand grip by positioning the thumb on the opposite side 26 of the handle directly over the tennis net indicium 27 which may also be embedded in the indentation 28 or retained as a decal on the surface of the side 26 without any indentation provided the decal is suitable protected. The thumb 29 shown in outline form in FIG. 4 is positioned directly over the indicium 24 should this grip be found to be more comfortable to the player after which the hand may be lowered to the wrapped portion 16 for play.

It has also been advantageous for service and overhead shots to position the hand for the grip shown in FIG. 2 with the bottom side of the knuckle placed on the tennis ball for the proper service grip or for hitting the overhead smash shot.

For the volley grip, the hand 19 is shown gripping the handle 13 so that the thumb 30 and the index finger 31 are so positioned in the grip to form a V-shaped opening 32 directly in line with the V in the word LOVE which is located on the side 33 opposite from the side on which the tennis ball indicium 24 is located with the indicium LOVE 34 being preferably inscribed in the indentation 35 in the side 33 of the handle.

The word LOVE that is located on the side 33 conveys the meaning for locating the volley grip in which the lettering LOV viewed upwardly is an abbreviation for volley. Here again, once the V-shaped opening 32 is formed in the grip in alignment with the V in the indicium 34, the hand may be lowered to the wrapped handle 16 for play.

Figure 6:
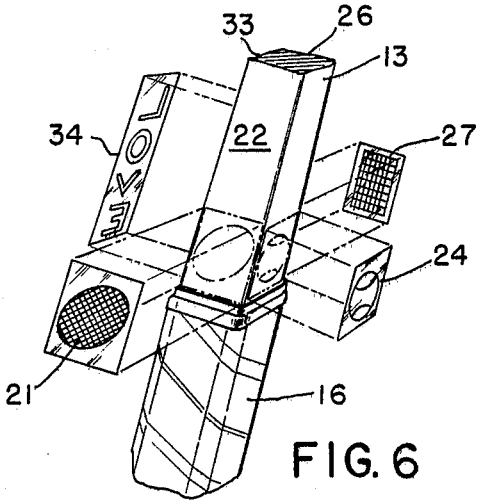
FIG. 6 is an exploded and partial perspective view of a portion of the tennis racket handle of FIGS. 1 through 4 illustrating the orientation of the indicia on each surface of the racket handle above the handle grip.

In FIG. 6, there is illustrated the four sides of the handle directly above the wrapped portion 16 with the indicia 21, 24, 27, and 34 extending outwardly from their respective sides. As previously indicated, the indicia 21, 24, 27 and 34 may be in the form of a decal or label that may be securely fastened by adhesive or other suitable means to the sides of the racket handle 13 and protected in a suitable manner by an appropriate protective coating in order to prolong the life of the indicia as a guide for each of the various grips indicated.

It will be readily apparent that the specific indicia disclosed constitute but illustrative forms of one type and many other suitable indicium or markings may be employed with equal efficacy. Furthermore, it is contemplated that the various indicia may be carved into the wrapping 16 or soft spots may be employed as guide points for the player using urethane under the wrapping 16.

I claim:

1. A tennis playing and training racket comprising a frame with strings having forward and rear faces, a handle extending from said frame and having a neck intermediate said handle and frame, said handle having a plurality of sides, one of said sides being substantially coplanar with said rear face, a handle wrapping on the lower portion of said handle, indicia means on said one side positioned above and in spaced relation to the handle wrapping for positioning and orienting the player's hand grasp for a forehand stroke, said indicia means having an indentation for cooperatively receiving and positioning the underside of the index knuckle of the player's hand grasp before displacing the player's hand to a lowered position on said handle wrapping for normal playing while retaining the pre-oriented hand grasp.

2. A tennis playing and training racket as claimed in claim 1, said indicia means including a second indented indicium on said handle substantially at right angles to said one side for positioning and orienting the player's hand grasp for a backhand stroke with the index knuckle of the player cooperatively receivable in said second indicium.

3. A tennis playing and training racket as claimed in claim 2, said indicia means including a third V-shaped indented indicium on the handle side opposite said second indicium for grasping the handle for volley play in which the hand grasp forms a V-shape between the thumb and index knuckles on said handle substantially in alignment with and cooperating with said third V-shaped indented indicium.

4. A tennis playing and training racket as claimed in claim 2, said indicia means including a fourth indented indicium on the handle side above said handle wrapping on the face side for cooperatively receiving and positioning the thumb of the player for a backhand grip before repositioning the hand grasp on the handle wrapping.

5. A tennis playing and training racket as claimed in claim 1, said indicia means including a decal securely fastened to the handle in said indentation above the wrapped portion on said one side, said decal being elliptically-shaped within said indentation.

* * * * *